United States Patent [19]

Hancock

[11] 3,977,029

[45] Aug. 31, 1976

[54] BOX SPRING ASSEMBLY WITH COATED WIRE COMPONENTS

[75] Inventor: William L. Hancock, Lexington, Ky.

[73] Assignee: Hoover Ball and Bearing Company, Saline, Mich.

[22] Filed: Sept. 18, 1974

[21] Appl. No.: 506,946

[52] U.S. Cl. ..... 5/259 R; 5/247; 5/267

[51] Int. Cl.[2] ..... A47C 23/04

[58] Field of Search ..... 5/247, 259 R–261, 5/267, 351; 297/445

[56] References Cited

UNITED STATES PATENTS

| | | | |
|---|---|---|---|
| 3,286,281 | 11/1966 | Slominski | 5/247 |
| 3,487,480 | 1/1970 | Slominski | 5/247 |
| 3,709,559 | 1/1973 | Rowland | 297/445 |
| 3,774,967 | 11/1973 | Rowland | 297/445 |

*Primary Examiner*—Casmir A. Nunberg
*Attorney, Agent, or Firm*—Olsen and Stephenson

[57] ABSTRACT

A box spring assembly having a generally rectangular frame consisting of side and end rails and a plurality of spaced cross rails extending between the side rails, a border wire conforming generally to the shape and boundaries defined by the side and end rails, a plurality of longitudinal and transverse main springs parallel to the side and end rails and perpendicular to each other, and a plurality of internal support springs extending diagonally between pairs of main springs, all of the springs being of the formed wire type. Each main spring is attached to the border wire by a clip, and either the border wire or the spring or both are coated with a plastic material to preclude slippage of the clip. Furthermore, each internal support spring is attached to a pair of main springs by a clip, and either the support spring or the main spring or both are coated with plastic. All the wires may be coated with a different color plastic to facilitate assembly of the product. The invention also includes a process for converting straight wire into a spring which is then heat treated and exposed to a fluidized bed for coating, the quality of the resulting coating being indicative of the quality of the heat treatment.

3 Claims, 6 Drawing Figures

FIG. 3
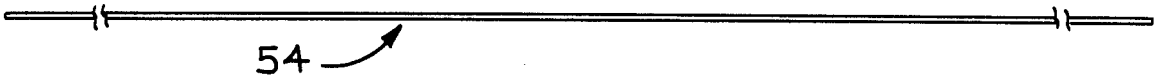
FIG. 4
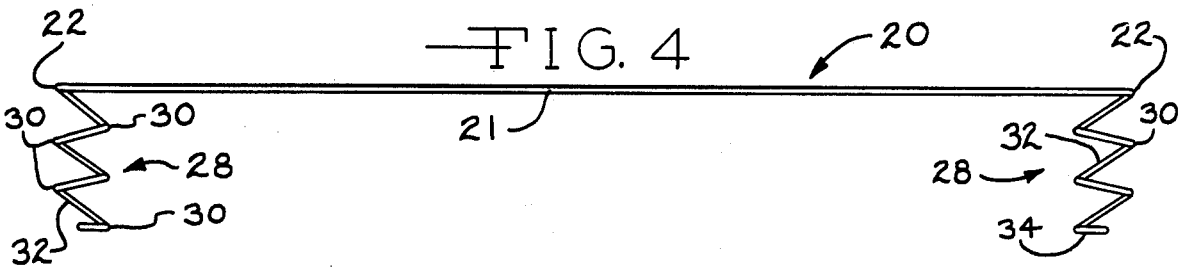
FIG. 5
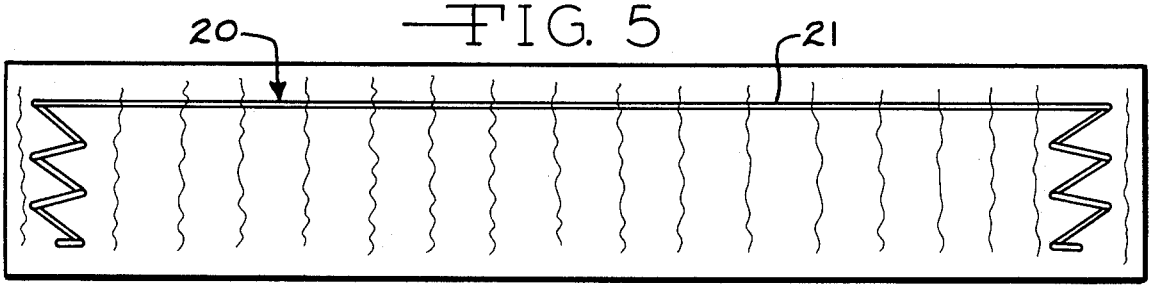
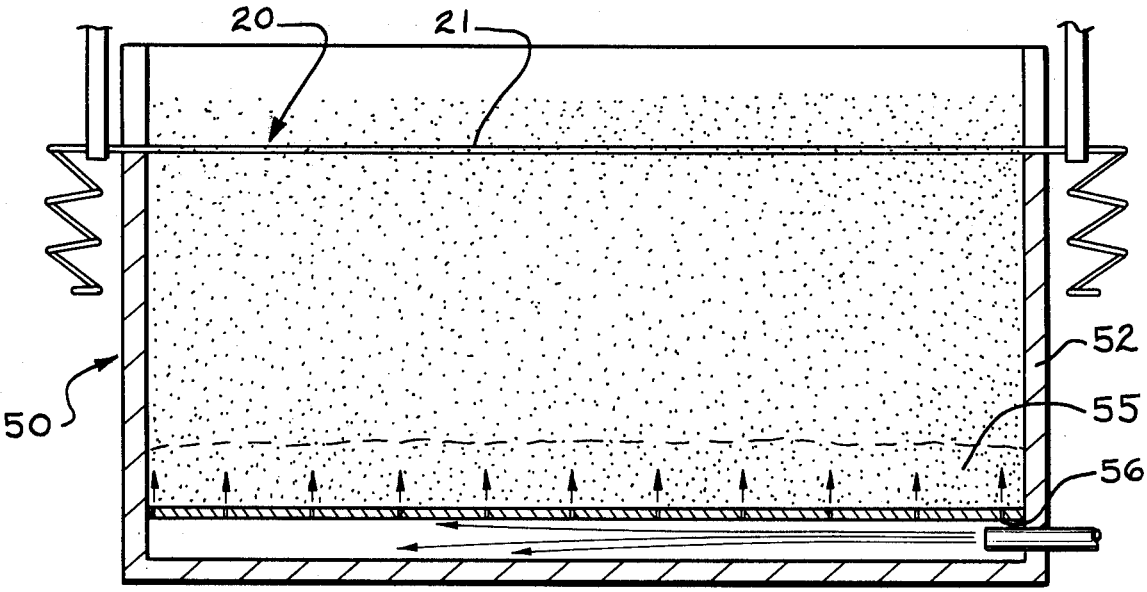
FIG. 6
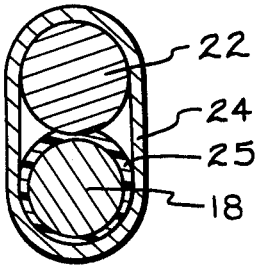
FIG. 2

BOX SPRING ASSEMBLY WITH COATED WIRE COMPONENTS

BACKGROUND OF THE INVENTION

The formed wire box spring assembly currently in use consists of a generally rectangular frame having a pair of side rails and a pair of end rails, a plurality of cross rails extending between the side rails, a border wire running along the perimeter of the frame as defined by the side and end rails, a plurality of longitudinal and transverse main springs each terminating at and being attached to the border wire, and several support springs located within the borders of the frame. The springs of this assembly are of the formed wire type, being composed of a straight wire bent at both ends so that the bent portion of the wire comprises a series of bars arranged in a zigzag shape and capable of resisting loads. The main springs are attached to the border wire and the support springs are attached to the main springs by metal clips each of which encircles two side-by-side portions of wire and holds them together. Because there is limited friction between metal wire and metal clip, the clips tend to slide on the wire. When a spring is imperfectly formed or mounted, it may even tend to slide the clip out of position. This movement in turn enables the springs to move out of position which adversely affects the functional performance of the assembly. It is an object of the present invention, therefore, to provide an improved box spring assembly in which the clips are mounted on plastic coated wires which prevent the clips from slipping thereby insuring that each spring will be secured in its intended position in which it will act and react in the way in which it was intended.

SUMMARY OF THE INVENTION

The present invention provides, in a preferred form, a box spring assembly in which at least portions of the springs are coated with a yieldable plastic material. By coating the portions of the springs on which the clips are mounted, the metal clips are able to secure the springs more tightly, as the plastic coating has a substantial amount of "give" and allows the clips to bite in. Also, the plastic coating increases the friction between the clips and the wires. As a result, the clips will not slip and the springs will remain in their intended positions.

The invention further provides a continuous process by which straight wire is bent into the desired shape to form a spring, is then subjected to a stress relieving heat treatment, and immediately thereafter coated with a thermoplastic. The coating process is accomplished by immersing the heated wire in a fluidized bed in such a way that only the straight portion of the wire is exposed to the bed. This process not only coats the wire for the purpose of clip retention, but also enables a visual check on the heat treating process. If too much or too little heat is applied during heat treatment the coating on the final product will visually reflect this, and the imperfect part will be easily recognized by an inspector. Another feature of this process is the fact that no cleaning or priming of the product is required before the wire is coated. Also, the different types of wires can be coated with different colors of coating. The wires are then color-coded to facilitate assembly of the product.

Further objects, features and advantages of this invention will become apparent from a consideration of the following description, the appended claims, and the accompanying drawing in which:

FIG. 2 is a transverse sectional view of a metal clip and the pair of wires it secures as seen from substantially the line 2—2 in FIG. 1;

FIG. 3 is a foreshortened side view of a length of straight wire before bending;

FIG. 4 is a side view of the wire after being bent to form a main spring in the box spring assembly of this invention;

FIG. 5 is a diagrammatic view of the wire spring being subjected to heat treatment; and FIG. 6 is a transverse sectional view of the wire spring being exposed to the fluidized bed.

Figure 1:
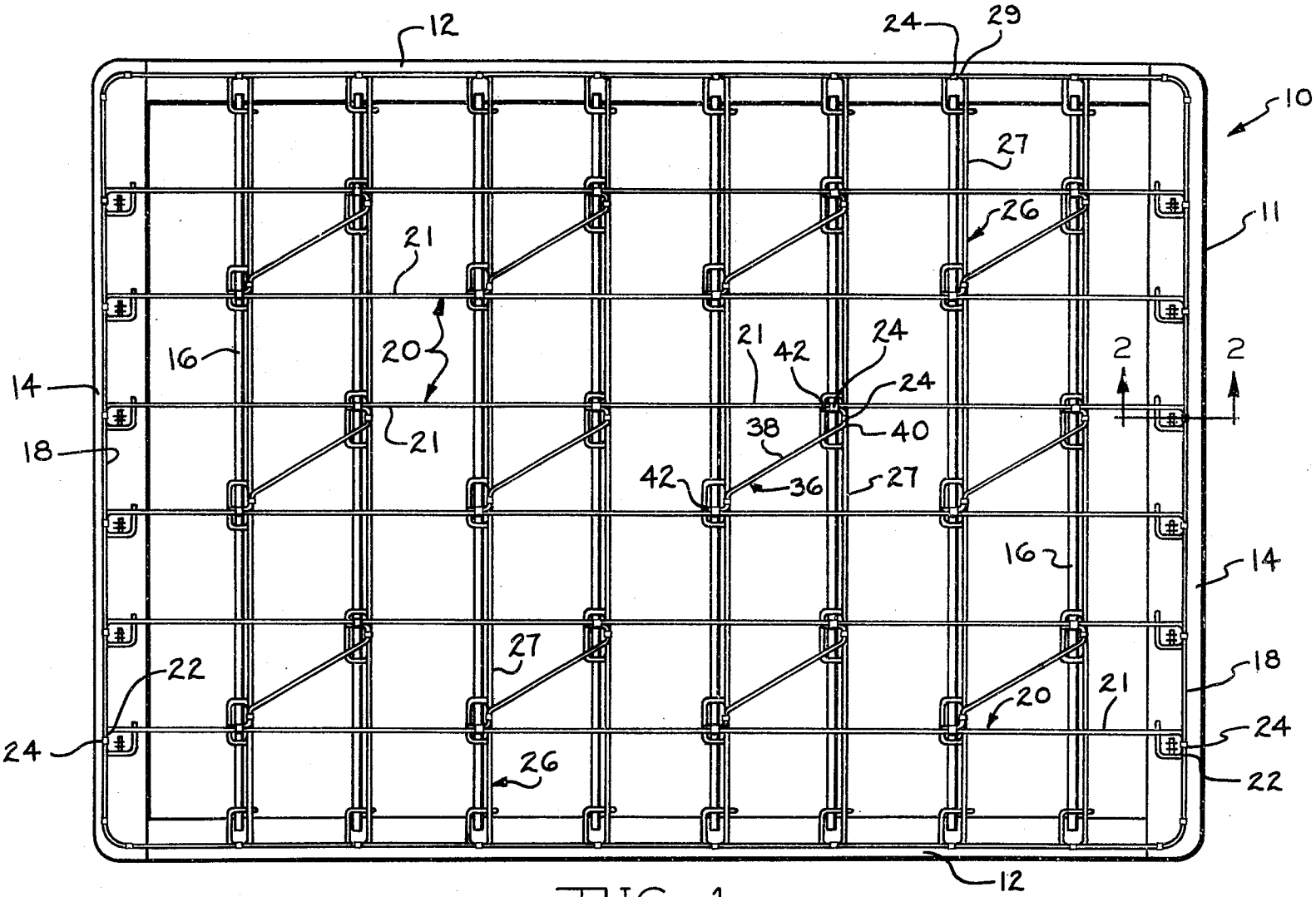
FIG. 1 is a plan view of the box spring assembly of this invention.

With reference to the drawing, the box spring assembly of this invention, indicated generally at 10, is shown in FIG. 1 as including a generally rectangular main frame 11 having a pair of side rails 12, a pair of end rails 14, and a plurality of cross rails 16 which are substantially parallel to the end rails 14. A border wire 18, located above the frame 11, runs along the perimeter of the frame defined by the side rails 12 and the end rails 14 and conforming to the rectangular shape of frame 11. A plurality of longitudinal main springs 20 are located perpendicular to the cross rails 16 and mounted lengthwise on the frame 11. Each of the longitudinal springs 20 is formed with a straight body portion 21 having transverse bars 22 at the ends thereof which run parallel to and adjacent portions of the border wire 18. Each bar 22 is attached to the border wire 18 by a conventional clip member 24.

At least one of the two aforementioned wires, namely, the bar 22 or the wire 18 is provided with a yieldable thermoplastic coating 25 (FIG. 2) so that the clip member 24 can bite into the coating and encircle the border wire 18 and the longitudinal spring 20 more tightly, thereby precluding slippage of the clip member 24. In the present embodiment of the invention, the border wire 18 is coated. A plurality of transverse main springs 26, substantially parallel to each other and to the cross rails 16, are mounted on the frame 11 in a criss-cross relation with the main springs 20. The transverse springs 26 have straight body portions 27 formed at their ends with transverse bars 29 which are attached to the coated border wire 18 in essentially the same manner as are the longitudinal main spring bars 22.

A main spring 20 is more clearly illustrated in FIG. 4 as including the straight body portion 21 which terminates at its ends in the transverse bars 22 and has depending yieldable formed wire spring portions 28 below the bars 22. Each spring portion 28 consists of alternately arranged torsion bars 30 and inclined connecting bars 32 terminating at its lower end in a foot 34 mounted on the main frame 11. The spring portions 28 are described in detail in co-pending application Ser. No. 362,887 filed May 23, 1973, now U.S. Pat. No. 3,852,838. The spring 26 is identical to the spring 20, differing therefrom only in the length of the body portion 21.

The box spring assembly also includes a plurality of internal support springs 36, each of which extends diagonally between pairs of main springs 20 and 26. The springs 36 are preferably located as shown in U.S. Pat. No. 3,286,281. Each internal support spring 36 has a straight wire body portion 38 that terminates at each end in a pair of right angle bars 40 and 42. Each bar 42 has a depending formed wire spring portion like the spring portion 28 described above. The body portion 38 extends diagonally across the rectangle formed by the criss-cross spring body portions 21 and 27 and the bars 40 and 42 are arranged parallel to the body portions 27 and 21, respectively. Conventional clips 24 secure the bars 40 and 42 to the body portions 27 and 21, respectively. As will be explained more in detail hereinafter, the main spring body portions 21 and 27 are also provided with the coating 25 of a thermoplastic material which will yield sufficiently to enable the clips 24 to bite into and securely grip the body portions. This insures that the springs 20, 26 and 36 will be retained in their desired relative positions.

FIGS. 3–6 show the process by which straight wire is converted to a main spring, is heat treated, and provided with the yieldable coating 25. As seen in FIGS. 3 and 4, a length of straight wire 54 is bent upon itself in such a way as to produce the bars 22 with the depending resilient spring portions 28. The spring 20 is then subjected to heat treatment, as shown in FIG. 5, adequate for stress relief purposes. The ideal heat treatment is designed to relieve internal stresses within the spring 20 caused by bending of the metal and is achieved at a temperature in the 450°F to 550°F range. In FIG. 5, the entire spring 20 is shown being heat treated. Heat treat can also be accomplished by gripping the ends of the straight wire portion 21 in a pair of electrodes and passing current through the spring 20 in an amount adequate to heat the spring 20.

The spring 20 is then immediately subjected to a fluidized bed. indicated generally at 50 in FIG. 6. As can be seen from FIG. 6, only the straight portion 21 of the spring 20 is exposed to the fluidized bed 50. The bed 50 consists of a housing 52 containing a thermoplastic material 55, in a substantially powder form, which is circulated by air under pressure entering housng 52 through small air holes 56, forcing the powder upwards. The powder then becomes suspended in the air to form the bed. When the spring portion 21, which is at a high temperature due to the previous heat treatment, is immersed in the bed, the plastic powder particles adhere to and flow onto the metal part. The plastic coating thus formed then hardens after cooling, producing the plastic coating 25 on the spring portion 21. This method will not only coat the wire for the purpose of retaining the clip member 24, but will also provide a visual check on the heat treatment process.

One of the principal advantages of the present invention is the quality control that the present coating method provides. The powder 55 is a heat curable flexible thermoplastic material of a predetermined color designed for direct fluidized bed application to heated metal surfaces. Examples are:

"Scotchkote" primerless vinyl (400 Series) sold by 3M Company of St. Paul, Minnesota; and Vinyl Powder 8040 sold by M & T Chemicals, Inc. of Rahway, New Jersey.

When the heat treat temperatures of the spring is below the above temperature range, the vinyl coating will have a readily recognizable sandy appearance and graying texture. If the temperature is above the range, the coating will be blistered and discolored. In either event, the inspector will know immediately to reject the part for improper heat treatment.

From the above description, it is seen that this invention provides an improved box spring assembly in which the clips 24 will remain in assembled position during use of the assembly 10. The coating 25 on the wires 18 and 21 assures clip stability. In addition, the various assembly components can readily be color-coded by the coated thereon for ease of assembly purposes and the quality of the coating provides a ready check on the adequacy of the heat treat. The combining of heat treat and coating steps also simplifies coating of the springs.

What is claimed is:

1. In a box spring assembly which includes a generally rectangular support frame having a pair of end rails and a pair of side rails, a plurality of main wire springs mounted on said frame, said main springs including a plurality of longitudinal springs generally parallel to said side rails and a plurality of transverse springs generally parallel to said end rails, each of said main springs having a substantially straight body section and depending resilient end portions supported on said frame, a plurality of internal support springs supported on said frame, each of said support springs extending between a pair of said main springs, each of said internal support springs having end sections arranged parallel to and side-by-side with the body sections of a pair of said main springs, said last mentioned body sections having a coating thereon formed of a yieldable material, and clip members tightly encircling said side-by-side sections and urging said sections toward each other into frictional engagement with each other so as to securely connect said sections, said clips biting into said coating so as to preclude movement of said side-by-side sections relative to each other and relative to said clips.

2. A box spring assembly comprising a generally rectangular support frame, a plurality of main springs mounted on said frame, each of said main springs having a straight body section and depending resilient end portions mounted on said frame, means forming a generally rectangular border wire conforming generally to the shape of said support frame and disposed above said support frame, each of said main springs having sections thereof at the ends of the body section thereof which are parallel to and arranged side-by-side with sections of said border wire, said border wire sections having a coating thereon formed of a yieldable material, and clip members tightly encircling said side-by-side sections and urging said sections toward each other into frictional engagement with each other so as to securely connect said sections, said clips biting into said coating so as to preclude movement of said side-by-side sections relative to each other and relative to said clip.

3. In a box spring assembly which includes a generally rectangular support frame having a pair of end rails and a pair of side rails, a plurality of main wire springs mounted on said frame, said main springs including a plurality of longitudinal springs generally parallel to said side rails and a plurality of transverse springs generally parallel to said end rails, each of said main springs having a substantially straight body section and depending resilient end portions supported on said frame, a plurality of internal support springs supported on said frame, each of said support springs extending between a pair of said main springs, each of said internal support springs having end sections arranged parallel to and side-by-side with the body sections of a pair of said main springs, said last mentioned body sections having a coating thereon formed of a yieldable material, means forming a generally rectangular border wire conforming generally to the shape of said support frame and disposed above said support frame, each of said main springs having sections thereof at the ends of the body section thereof which are parallel to and arranged side-by-side with sections of said border wire, said border wire sections having a coating thereon formed of a yieldable material, and clip members tightly encircling said side-by-side sections and urging said sections toward each other into frictional engagement with each other so as to securely connect said sections, said clips biting into said coating so as to preclude movement of said side-by-side sections relative to each other and relative to said clips.

* * * * *